US011285728B2

(12) United States Patent
FitzGerald et al.

(10) Patent No.: US 11,285,728 B2
(45) Date of Patent: Mar. 29, 2022

(54) COLORANT SENSORS

(71) Applicant: HEWLETT-PACKARD DEVELOPMENT COMPANY, L.P., Spring, TX (US)

(72) Inventors: Sean Daniel FitzGerald, Boise, ID (US); Jeff Luke, Boise, ID (US); Mathew Lavigne, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/763,848

(22) PCT Filed: Apr. 13, 2018

(86) PCT No.: PCT/US2018/027599
§ 371 (c)(1),
(2) Date: May 13, 2020

(87) PCT Pub. No.: WO2019/199327
PCT Pub. Date: Oct. 17, 2019

(65) Prior Publication Data

US 2021/0170758 A1 Jun. 10, 2021

(51) Int. Cl.
*B41J 2/175* (2006.01)
*G03G 15/08* (2006.01)

(52) U.S. Cl.
CPC ..... *B41J 2/17566* (2013.01); *B41J 2/175* (2013.01); *B41J 2002/17573* (2013.01); *G03G 15/0848* (2013.01)

(58) Field of Classification Search
CPC ..... B41J 2/17566; B41J 2/175; B41J 2002/17573; G03G 15/0848
See application file for complete search history.

(56) References Cited

U.S. PATENT DOCUMENTS

| | | | | |
|---|---|---|---|---|
| 3,872,824 | A | 3/1975 | Erny | |
| 4,155,652 | A * | 5/1979 | Buchan | G03G 15/0855 118/691 |
| 6,256,459 | B1 | 7/2001 | Hasegawa | |
| 6,520,612 | B1 | 2/2003 | Merz et al. | |
| 7,040,728 | B2 | 5/2006 | Merz et al. | |
| 9,573,380 | B2 | 2/2017 | Ishida | |
| 2001/0042468 | A1 | 11/2001 | Inoue | |
| 2003/0072580 | A1 | 4/2003 | Itoh | |

(Continued)

FOREIGN PATENT DOCUMENTS

| | | | |
|---|---|---|---|
| EP | 1857285 | B1 | 3/2011 |
| EP | 1653298 | A1 | 1/2016 |
| JP | S61180266 | A | 8/1986 |

*Primary Examiner* — Geoffrey S Mruk
(74) *Attorney, Agent, or Firm* — Staas & Halsey LLP

(57) ABSTRACT

In various examples, colorant sensors can include a printing device comprising a hopper to receive a colorant, a supply to receive the colorant from the hopper, an aperture disposed between the hopper and the supply, a light emitter to emit light that passes through the aperture, and a light sensor located on the opposite side of the aperture relative the light emitter to sense a portion of the emitted light that passes through the aperture to permit determination of whether colorant present in the aperture based on the portion of the emitted light sensed by the light sensor.

13 Claims, 4 Drawing Sheets

(56) References Cited

U.S. PATENT DOCUMENTS

| | | | |
|---|---|---|---|
| 2006/0051110 | A1 | 3/2006 | Koyama |
| 2012/0224889 | A1 | 9/2012 | Tajiri |
| 2016/0147181 | A1 | 5/2016 | Inoue |

* cited by examiner

COLORANT SENSORS

CROSS REFERENCE TO RELATED APPLICATIONS

This application is a U.S. National Stage Application which claims the benefit under 35 U.S.C. § 371 of International Patent Application No. PCT/US2018/027599 filed on Apr. 13, 2018, the contents of which are incorporated herein by reference.

BACKGROUND

Various printing devices may apply a quantity of printing fluid and/or particulates to a print medium such as paper or other type of print medium. The printing devices may include a supply that contains the printing fluid and/or particulates.

DETAILED DESCRIPTION

As mentioned, printing devices can apply a quantity of colorant such as printing fluid and/or particulates to a print medium. Examples of printing devices include ink/toner printers and/or three-dimensional printers, among other types of printing devices. The printing devices can include a supply to provide colorant to a printhead and/or other component that can apply colorant to a print medium. The supply may have a finite amount of colorant disposed within a volume of the supply. As such, the amount of colorant in the supply may be reduced during operation of the printing device, for instance, due to application of colorant from the supply to print media. At some point, an amount of colorant in the supply may be less than a threshold amount of colorant for the printing device to operate as intended. As such, the supply may be refilled with additional colorant to maintain an amount of colorant that is greater than the threshold amount of colorant.

However, refilling of the supply with colorant takes time. It may also be unclear to an end user when the supply is sufficiently refilled and/or when the supply is full of colorant. As such, identifying when the supply is sufficiently refilled and/or full of colorant may be desirable. Some approaches attempting to identify when a supply is sufficiently refilled (e.g., above a threshold amount) and/or full have employed weight-based approaches such as those that weigh a supply and based on the weight estimate whether the supply is full. However, such approaches may be costly, inaccurate, and/or may not provide other information such as determination of when a refill of the supply is has begun, is underway, and/or is complete.

As such, the disclosure is directed to colorant sensors such as those included in a printing device. For example, a printing device can include a hopper to receive a colorant, a supply to receive the colorant from the hopper, an aperture disposed between the hopper and the supply, a light emitter to emit light that passes through the aperture, and a light sensor located on the opposite side of the aperture relative the light emitter to sense a portion of the emitted light that passes through the aperture to permit determination of whether colorant is present in the aperture based on the portion of the emitted light sensed by the light sensor, as described herein. Notably, colorant sensors can identify when a refill of the supply is has begun, is underway, and/or is complete (e.g., when a supply is full of colorant), as described herein.

Figure 1:
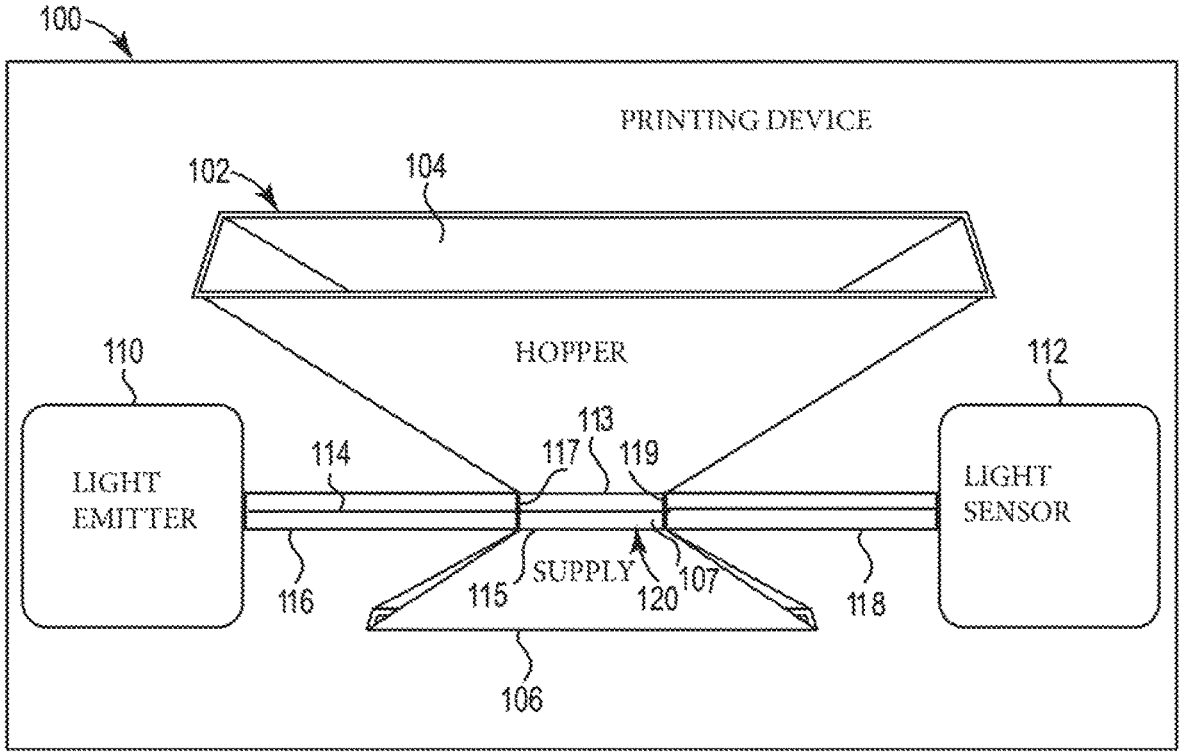
FIG. 1 illustrates a diagram of an example of a printing device according to the disclosure.

FIG. 1 illustrates a diagram of an example of a printing device 100 according to the disclosure. As used herein the printing device refers a device such as printers, copiers, etc., may generate text and/or images, etc. onto print media (e.g., paper, plastic, etc.). As illustrated in FIG. 1, printing device 100 can include a hopper 102, a supply 106, a light emitter 110 to emit light (represented by the line identified by the element number 114), a light sensor 112 to sense the emitted light 114, and an aperture 120.

The hopper 102 defines a volume 104 to receive a colorant (not present in FIG. 1). As used herein, colorant refers to printing fluids such as ink and/or particulates such as toner. Examples of printing fluids include various types of inks, binding fluids, fusing agent, among other types of printing fluids. Examples of particulates include toner, carrier beads, polymers, and/or metallic particulates such as those suitable for three-dimensional printing. That is, in some examples the colorant is a particulate colorant.

As used herein, a hopper refers to a container to receive colorant in the volume 104 of the hopper and includes an opening to transfer the received colorant from the volume 104 of the hopper 102 to another apparatus such as a supply. The volume 104 of the hopper 102 can be less than, greater than, or equal to a volume of a supply such as the supply 106.

As illustrated in FIG. 1, the hopper 102 can be tapered (e.g., from an inlet and narrowing progressively toward an outlet). However, the disclosure is not so limited. Rather, the hopper 102 can be shaped, sized, and/or otherwise oriented in a variety of manners. In some examples, a printing device can be without a hopper, for instance, as detailed herein with respect to FIG. 4 in which the printing device is to directly receive a colorant into a supply of the printing device without a hopper. It is understood that the hopper 102 can, in some examples, be removed from the printing device 100.

As illustrated in FIG. 1, the hopper 102 can be coupled to the supply 106. As such, the hopper 102 can permit transfer of colorant from the hopper 102 to the supply 106. As used herein, a supply refers to a component that is coupled to and is to provide colorant to a printhead, development area, and/or other imaging component of a printing device. While illustrated in FIG. 1, a portion of the supply 106 can be visible on an external portion of the printing device. However, it is noted that the supply 106 can include and/or be coupled to various other component to permit supplying a colorant from the supply to a printhead (not illustrated), development area, and/or other imaging component that can apply a colorant to a print medium. For instance, the supply 106 can be coupled to a pump to form part of an ink delivery system (IDS) within the printing device 100. The IDS can cause colorant such as printing fluid to flow to printheads from the supply 106. In some examples, the supply 106 can be coupled to a development area of the printing device 100 and can permit providing the colorant to a print medium.

As illustrated in FIG. 1, the aperture 120 can be disposed between the hopper 102 and the supply 106. As used herein, an aperture refers to an opening through which light can pass. An aperture can be internal to a printing device as illustrated in FIG. 1 or can be external to a printing device as described herein with respect to FIG. 4. As used herein, an aperture being internal to a printing device refers to an aperture having a volume defined by at least two components (e.g., a hopper and a supply) of the printing device. As used herein, an aperture being external to the printing device refers to an aperture having a volume defined by one or fewer components of the printing device. For instance, as illustrated with respect to FIG. 4 an aperture can be external to a printing device when the aperture is located in a container.

For ease of illustration the aperture 120 is represented as being visible from an outside of the printing device. In such examples, the aperture can be covered by a transparent material (not illustrated) to permit viewing inside of the aperture 120 from outside of the printing device. However, it is understood that in some examples the aperture can be obscured from view from outside of the printing device by an opaque material such as plastic and/or metal, among other types of materials.

In some examples, a volume 107 of the aperture 120 can be defined in part by a surface of a light pipe. As used herein, a light pipe refers to a physical structure that can transmit and/or distribute natural or artificial light. Examples of light pipes include fiber optic cables and various physical structures having a hollow portion to distribute natural or artificial light. In some examples, a volume 107 of the aperture 120 can be defined in part by a surface of a first light pipe 116, a first surface 113 of the hopper 102, a second surface 115 of the supply 106, a third surface 117 of a first light pipe 116, and/or a fourth surface 119 of a second light pipe 118. That is, as illustrated in FIG. 1, a volume 107 of the aperture 120 can be defined by each of the first surface 113, the second surface 115, the third surface 117, and the fourth surface 119. However, the disclosure is not so limited. For instance, the first light pipe 116 and/or the second light pipe 118 can be removed and therefore the volume of the apparatus can be defined at least in part by the first surface 113 and the second surface 115, by the first surface 113, the second surface 115, and the third surface 117, and/or by the first surface 113, the second surface 115, and the fourth surface 119.

The first surface 113 can include an opening (not illustrated). Similarly, the second surface 115 can include a corresponding opening (not illustrated) to permit the supply 120 to receive colorant, when present, from the hopper 102 via the opening in the first surface 113 and the corresponding opening in the second surface 115.

The third surface 117 can include an opening and/or can include a transparent material. Similarly, the fourth surface 119 can include a corresponding opening and/or can include a transparent material to permit light 114 emitted by the light emitter 110 to pass through each of the third surface 117 and the fourth surface 119.

The light emitter 110 refers to a device that can emit artificial light. Examples of light emitters includes incandescent bulbs, light emitting diodes, among other types of light emitters. For instance, in some examples the light emitter 110 can be a visible light emitter to emit light visible to an unaided human eye. However, the light emitter can emit infrared light, among other possible light types along the electromagnetic spectrum. In any case, the emitted light 114 can enter the aperture 120 and a portion of the emitted light 114 can pass through the aperture 120 on its way to the light sensor 112.

The light sensor 112 refers to a photo or optical detector. As illustrated in FIG. 1, the light emitter 110 and the light sensor 112 are spaced from one another on opposite sides of the aperture 120. As such, the light sensor 112 can sense a portion of the emitted light that passes through the aperture 120. For instance, the light sensor 112 can sense a given amount of light over a period of time. The given amount of light sensed can be compared (e.g., by a controller as described herein) to an amount of light emitted by the light emitter 110 over the same period of time to permit determination of whether colorant is present in the aperture based on the portion of the emitted light sensed by the light sensor, as detailed herein.

As illustrated in FIG. 1, the light emitter 110 and the light sensor 112 can be positioned in along a common axis (coplanar with the path of the emitted light 114). That is, the light emitter 110 and the light sensor 112 can be positioned along a line of sight with respect to each other. As such, the printing device 100 can be free of (i.e., without) an intervening optical element such as a mirror between the light emitter 110 and the light sensor 112. Examples of optical elements include devices such as mirrors and/or prisms.

Figure 2:
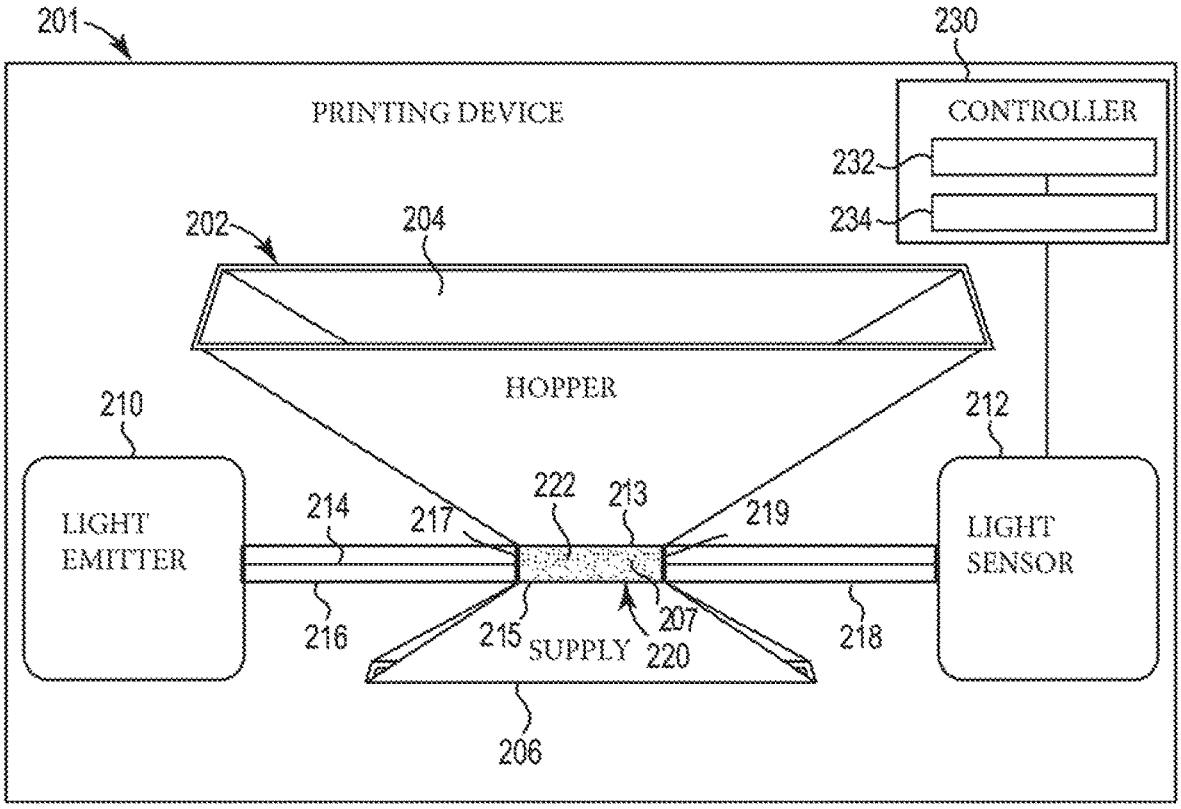
FIG. 2 illustrates a diagram of another example of a printing device according to the disclosure.

FIG. 2 illustrates a diagram of another example of a printing device 201 according to the disclosure. The printing device 201 may be analogous or similar to the printing device 100 as illustrated in FIG. 1. The printing device 201 can include a hopper 202 having a first surface 213 and having a volume to receive a colorant 222, a supply 206 having a second surface 215, a light emitter 210 to emit light (represented by the line identified by the element number 214) and having a third surface 217, a light sensor 212 to sense the emitted light 214 and having a fourth surface 219, and an aperture 220, among other components.

As illustrated in FIG. 2, the supply 206 can receive the colorant 222 from the hopper 202. As mentioned, the light emitter 210 can emit light 214 and a portion of the emitted light can pass through the aperture 220 and pass through and/or around the colorant 222 present in a volume 207 of the aperture 220. The light sensor 212 can detect a portion of the emitted light 214 that passes through the aperture 220.

As illustrated in FIG. 2, the light sensor 212 can be coupled to a controller 230, as illustrated in FIG. 2. The controller 230 can include hardware such as a processing resource 232 and a memory resource 234, among other electronics/hardware to perform functions described herein. For instance, the controller 230 can be a combination of hardware and non-transitory instructions to determine whether colorant is present in an aperture based on a portion of emitted light sensed by a light sensor, among other functions.

The processing resource 232, as used herein, can include a processor capable of executing instructions stored by the memory resource 234. Processing resource 232 can be integrated in an individual device or distributed across multiple devices (e.g., multiple printing devices). The instructions (e.g., non-transitory machine-readable instructions (MRI)) can include instructions stored on the memory resource 234 and executable by the processing resource 232 to implement a function (e.g., determine whether colorant is present in an aperture based on a portion of emitted light sensed by a light sensor, etc.).

The memory resource 234 can be in communication with the processing resource 232 and/or another processing resource. A memory resource, as used herein, can include components capable of storing instructions that can be executed by a processing resource. Such memory resource can be a non-transitory MRM. Memory resource 234 can be integrated in an individual device or distributed across multiple devices. Further, memory resource 234 can be fully or partially integrated in the same device as the processing resource 232 or it can be separate but accessible to that device and the processing resource 232. Thus, it is noted that the controller 230 can be implemented as part of or in conjunction with the systems and printing devices, as described herein.

The memory resource 234 can be in communication with the processing resource 232 via a communication link (e.g., path). The communication link (not illustrated) can be local or remote to a device associated with the processing resource. Examples of a local communication link can include an electronic bus internal to a device where the memory resource is one of volatile, non-volatile, fixed, and/or removable storage medium in communication with the processing resource via the electronic bus.

Figure 3:
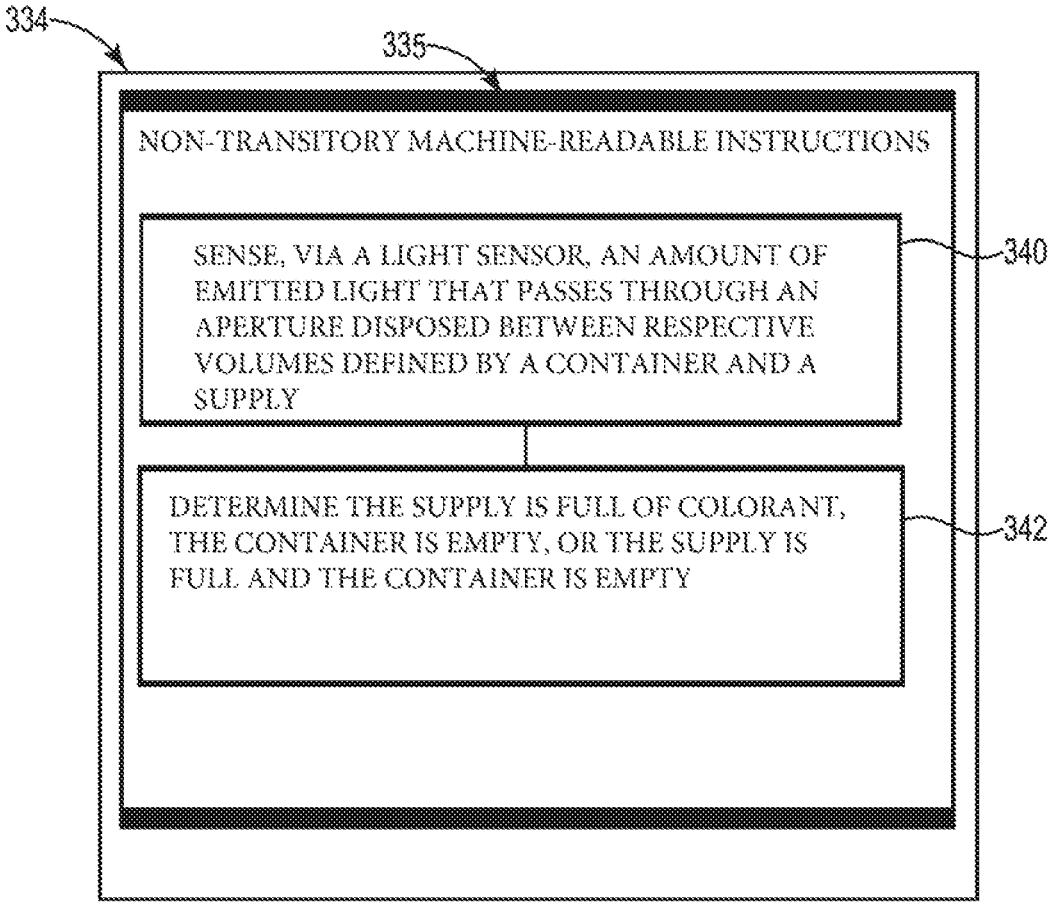
FIG. 3 illustrates an example of a storage medium including non-transitory machine-readable instructions according to the disclosure.

FIG. 3 illustrates an example of a storage medium 334 including non-transitory MRI 334 according to the disclosure. As illustrated at 340, the non-transitory MRI 335 can include instructions executable by a processing resource to sense, via a light sensor such as those described herein, an amount of emitted light that passes through an aperture disposed between respective volumes defined by a container and a supply.

The non-transitory MRI 335 can include instructions to compare the sensed portion of the emitted light to a total amount of emitted light. For example, if an amount of light received is above a threshold (e.g., 97%) than it can be determined colorant is not present in the aperture. Similarly, if an amount of light received is below a threshold (e.g., 97%) than it can be determined that an amount of colorant is present in the aperture.

As illustrated at 342, the non-transitory MRI 335 can include instructions executable by a processing resource to determine if a supply is full of colorant and/or if a container is empty of colorant. As used herein, a supply is "full" of colorant if an amount of colorant in the supply is above a given threshold (a threshold associated with an intended fill level when refilling an ink supply to a 'full' level) of colorant in the supply and/or a volume defined by the supply is equal to a volume of colorant in the supply. As used herein, a container is empty of colorant if an amount of colorant in the container is below a threshold of colorant in the container and/or a volume of the container is substantially free of colorant. For example, the supply can be determined to be "full" of colorant and/or a container can be determined to be "empty" responsive to a first portion of the emitted light sensed by the light sensor being below a threshold and responsive to the first portion being above the threshold, sense a second portion of the emitted light sensed by the light sensor that is above the threshold.

The non-transitory MRI 335 can include instructions to determine when various stages such as initiation, being underway, and/or completion of a refill process occur, among other possibilities. For instance, the non-transitory MRI 335 can include instructions to determine that a refill process has been initiated responsive to an amount of light being less than a threshold. In some examples, the non-transitory MRI 335 can include instructions to determined that a refill process is underway responsive to the amount of emitted light sensed being less than a threshold for each subsequent measurement of a plurality of subsequent measurements by the light sensor. In some examples, the non-transitory MRI 335 can include instructions to determine a refill process is complete responsive to an amount of emitted light sensed being below a threshold and a subsequent amount of emitted light sensed being above the threshold.

In some examples, the non-transitory MRI 335 can include instructions to dis-engage a lock mechanism to permit removal of the container from the print mechanism. For instance, responsive to the second portion of the emitted light sensed by the light sensor that is above the threshold the lock mechanism can be disengaged, among other possibilities. Such instructions can avoid inadvertent removal of the container from the printing device prior to the supply being full of colorant and/or the container being empty of colorant.

Figure 4:
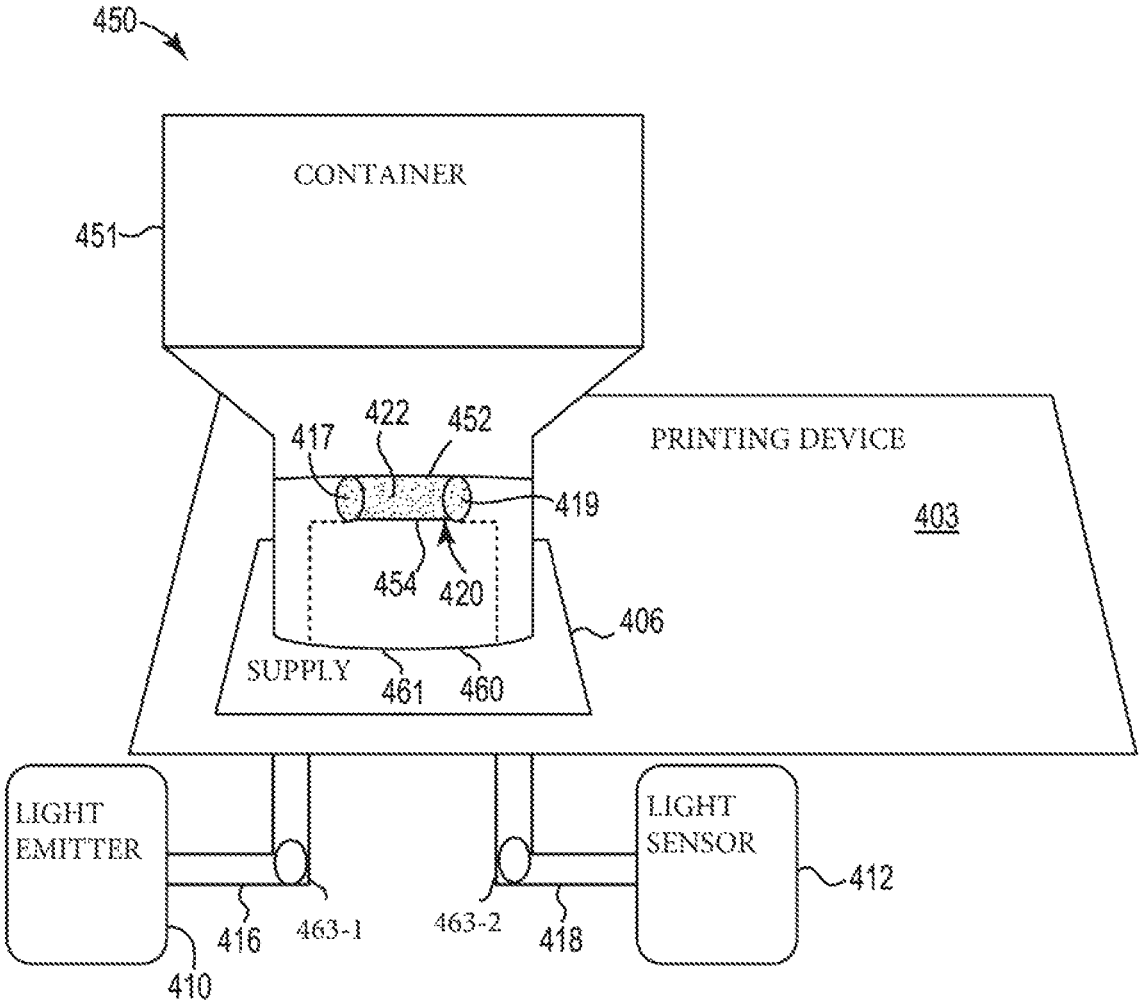
FIG. 4 illustrates a diagram of an example of a system according to the disclosure.

FIG. 4 illustrates a diagram of an example of a system 450 according to the disclosure. As illustrated, the system 450 can include a container 451 and a printing device 403. The printing device 403 may be analogous or similar to the printing device 201, as illustrated in FIG. 2 and/or printing device 100 as illustrated in FIG. 1. The printing device 403 can include light emitter 410 to emit light (not illustrated), and a light sensor 412 to sense the emitted light. For instance, as illustrated in FIG. 4, the light emitter 410 can emit light via a first light pipe 416 that can pass through aperture 420 and proceed through a second light pipe 418 to the light sensor 412.

The container 451 can define a volume to include a colorant. The container 451 can couple to the printing device 403. The container 451 can be removably coupled to the printing device 403 to permit couple, decoupling, and subsequent coupling of another container (not illustrated) to the printing device 403. When coupled to the printing device 403 the container can be in communication with a supply 406 of the printing device.

In some examples, the container 451 can include the aperture 420, as illustrate in FIG. 4. As illustrated in FIG. 4, the aperture 420 can be defined by a first surface 417 in a first light pipe 416, a second surface 419 in the second light pipe 418, and a third surface 452 and a fourth surface 454 in the container 451. That is, as illustrated in FIG. 4, the aperture 420 can be external to the printing device.

In some examples, the supply 406 further comprises a port 460 to couple the supply 406 to the container 451. The port 460 refers to an aperture or other type of opening. In some examples the supply 406 can include a lock mechanism 461 to removable couple the port 460 to the supply 406. Examples of lock mechanisms include interference fit mechanisms, snap mechanisms, among other types of mechanisms.

In some examples the container 451 can include optical elements such as mirrors or other optical elements to alter a path of light. For instance, the container 451 can include optical elements 463-1, 463-2 to couple the first light pipe 416 and the light emitter 410 via an optical element to the light sensor 412 to indirectly sense the portion of the emitted light. As used herein, indirectly sense refer to altering a direction of a path of light via optical elements such as 463-1 and/or 463-2 between a light emitter 410 and a light sensor 412.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. For example, reference numeral 102 may refer to element "02" in FIG. 1 and an analogous element may be identified by reference numeral 202 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense.

It will be understood that when an element is referred to as being "on," "connected to" or "coupled with" another element, it can be directly on, connected, or coupled with the other element or intervening elements may be present. In contrast, when an element is referred to as being "directly on," "directly connected to" or "directly coupled with" another element, there are no intervening elements or layers present.

As used herein, the term "and/or" includes any and all combinations of a number of the associated listed items. As used herein the term "or," unless otherwise noted, means logically inclusive or. That is, "A or B" can include (A), (B), or (both A and B). In other words, "A or B" can mean "A and/or B" or "at least A or B."

What is claimed:

1. A printing device comprising:

a hopper to receive a colorant;

a supply to receive the colorant from the hopper;

an aperture disposed between the hopper and the supply and having a volume defined by at least the supply;

a light emitter to emit light that passes through the aperture; and a light sensor located on the opposite side of the aperture relative to the light emitter to sense a portion of the emitted light that passes through the aperture between the hopper and the supply to permit determination of whether colorant is present in the aperture based on the portion of the emitted light sensed by the light sensor.

2. The printing device of claim 1, further comprising a light pipe disposed between the light emitter and the light sensor, wherein the light pipe is formed of a first light pipe coupled to the light emitter and a second light pipe coupled to the light sensor.

3. The printing device of claim 2, wherein a volume of the aperture is defined by a first surface of the hopper, a second surface of the supply, a third surface of the first light pipe, and a fourth surface of the second light pipe.

4. The printing device of claim 1, wherein the aperture is internal to the printing device.

5. The printing device of claim 1, wherein the light emitter and the light sensor are positioned along a common axis.

6. The printing device of claim 5, wherein the printing device is free of an intervening optical element between the light emitter and the light sensor.

7. The printing device of claim 1, wherein the colorant is a particulate colorant.

8. The printing device of claim 1, wherein the light emitter further comprises a visible light emitter.

9. A system comprising:

a printing device including:

a supply to receive a colorant;

a light emitter to emit light; and a light sensor to sense a portion of the emitted light;

a container to couple to the printing device, the container including:

a colorant disposed in an internal volume defined by the container; and an aperture disposed between at least a portion of the internal volume and the supply and having a volume defined by at least the supply.

10. The system of claim 9, further comprising a non-transitory machine-readable medium including instructions executable by a processing resource to sense whether colorant is present in the aperture.

11. The system of claim 9, wherein the supply further comprises a port to couple the supply to the container.

12. The system of claim 9, wherein the container further comprises optical elements to couple via a first light pipe and the light emitter is coupled via an optical element to the light sensor to indirectly sense the portion of the emitted light.

13. The system of claim 9, wherein the aperture in the container is external to the printing device.

* * * * *